United States Patent [19]

Sergeant

[11] 3,940,294

[45] Feb. 24, 1976

[54] COOLING OF HOT ROLLED STEEL STOCK

[75] Inventor: David Robert Sergeant, Maltby, near Rotherham, England

[73] Assignee: British Steel Corporation, London, England

[22] Filed: Oct. 7, 1974

[21] Appl. No.: 512,891

[30] Foreign Application Priority Data

Oct. 17, 1973 United Kingdom ..... 48350/73

[52] U.S. Cl. ..... 148/12 B

[51] Int. Cl.[2] ..... C21D 7/14

[58] Field of Search ..... 148/12 B, 12.4

[56] References Cited

UNITED STATES PATENTS

| | | | |
|---|---|---|---|
| 3,231,432 | 1/1966 | McLean et al. | 148/12 B |
| 3,389,021 | 6/1968 | Easter et al. | 148/12 B |
| 3,645,805 | 2/1972 | Hoffman et al. | 148/12 B |

*Primary Examiner*—W. Stallard

*Attorney, Agent, or Firm*—Bacon & Thomas

[57] ABSTRACT

This invention relates to a method of cooling hot rolled coiled bar in which the bar is water-cooled immediately after rolling to a temperature ($t_1'$) at which it is still sufficiently ductile to be readily coiled, in which it is then forced air cooled to a temperature ($t_1$) not less than that at which transformation of the body of the bar from austenite begins, in which it is then free air cooled to a temperature ($t_2$) not less than that at which scale transformation from wustite begins and in which the coiled bar is finally water-cooled to quench-in and suppress the transformation of the scale to magnetite.

Typical temperature ranges for mild steel, low/high carbon steels (up to 1%C), low alloy steels and semi/free-cutting steels would be $t_1'$ 830°C – 900°C, $t_1$ 700°C – 750°C, $t_2$ 480°C – 550°C.

10 Claims, 3 Drawing Figures

COOLING OF HOT ROLLED STEEL STOCK

This invention relates to a method of accelerating the cooling of hot rolled steel stock, e.g. bar, particularly coiled bar, and rod.

The object of this invention is to cool such stock in a manner which will ensure that the surface scale deposited can be easily removed.

In particular scale, a surface oxide layer, formed at hot rolling temperatures, say, 1100°C is composed of three stable oxides wustite (FeO), magnetite ($Fe_3O_4$) and hematite ($Fe_2O_3$). At about 700°C, below which the rate of oxidation decreases markedly, wustite constitutes about 95 percent of the scale and the latter becomes unstable below about 570°C becoming iron rich and finally decomposing into magnetite and iron (Fe) when slowly cooled.

Magnetite is very hard and is very difficult to remove from the parent steel, i.e. de-scaling is difficult and time-consuming irrespective of whether this is effected by chemical/electrochemical means or mechanical means. Consequently scale is frequently incompletely removed resulting in increased die wear during subsequent drawing operations and poor surface quality.

If very rapid cooling e.g. water-cooling is employed direct from the rolling temperature to a temperature below that of the scale transformation then clearly a minimal amount of scale will have developed and this will be predominantly untransformed wustite, but of course such a step is impracticable because quench-cracking could develop and the steel stock will be hardened to some degree, upsetting the structure and rendering further processing difficult.

In accordance with the present invention there is provided a method of cooling hot rolled steel stock in which the stock is rapidly cooled immediately after rolling to a temperature ($t_1$) not less than that at which transformation of the body of the stock from austenite begins, in which it is then free air cooled to a temperature ($t_2$) not less than that at which scale transformation from wustite begins and in which the stock is then water cooled to quench-in and suppress the transformation of the scale to magnetite.

The initial rapid cooling may comprise a water cooling step followed by forced air cooling; preferably the steel stock is bar, the bar being coiled after the initial water cooling, the water cooling being terminated at a temperature ($t_1'$) at which it is sufficiently ductile to be readily coiled, and the coiled bar then being forced air cooled to the said temperature ($t_1$). These rapid cooling steps are conducted at such a rate that no undesirable mechanical properties are manifested, the rate employed for a particular steel being determined from known transformation characteristics for that steel.

Typical temperature ranges for mild steel low/high carbon steels (up to 1% C), low alloy steels and semi/-free cutting steels are $t_1'$ 830°C – 900°C (e.g. for bar sizes 12.5mm and 40mm dia, respectively) $t_1$ 700°C – 750°C and $t_2$ 480°C – 550°C, the importance in the latter temperature residing in the desirability for transformation of the body of the steel to be complete before quenching otherwise an undesirable degree of hardening may result.

Water cooling after rolling may be effected by sprays directed on to the surfaces of the bar as it passes through a water box in the form of an elongated tube, the bar then being coiled on to a reel, and forced air cooled from the inside. The final water cooling step may be effected by submersion in a quench tank, the tank containing hot water so as to minimise subsequent rust formation.

Coiled bar treated in accordance with this invention has a considerably reduced scale thickness, it is predominantly wustite and it is more uniform by reason of the accelerated cooling, whereas hitherto, with free cooling the inner laps have taken much longer to cool than the outer laps resulting in a thick transformed scale. By the same token the micro-structure of the steel is more uniform and the surface finish is improved.

The improvement in de-scaling properties results in improved pickling times, in some instances by over 50%.

A further advantage to accrue is that since cooling is accelerated, the length of conveyor required for cooling is much shorter than before.

In order that the invention may be fully understood, one embodiment thereof will now be described with reference to the accompanying drawings in which.

Figure 1:
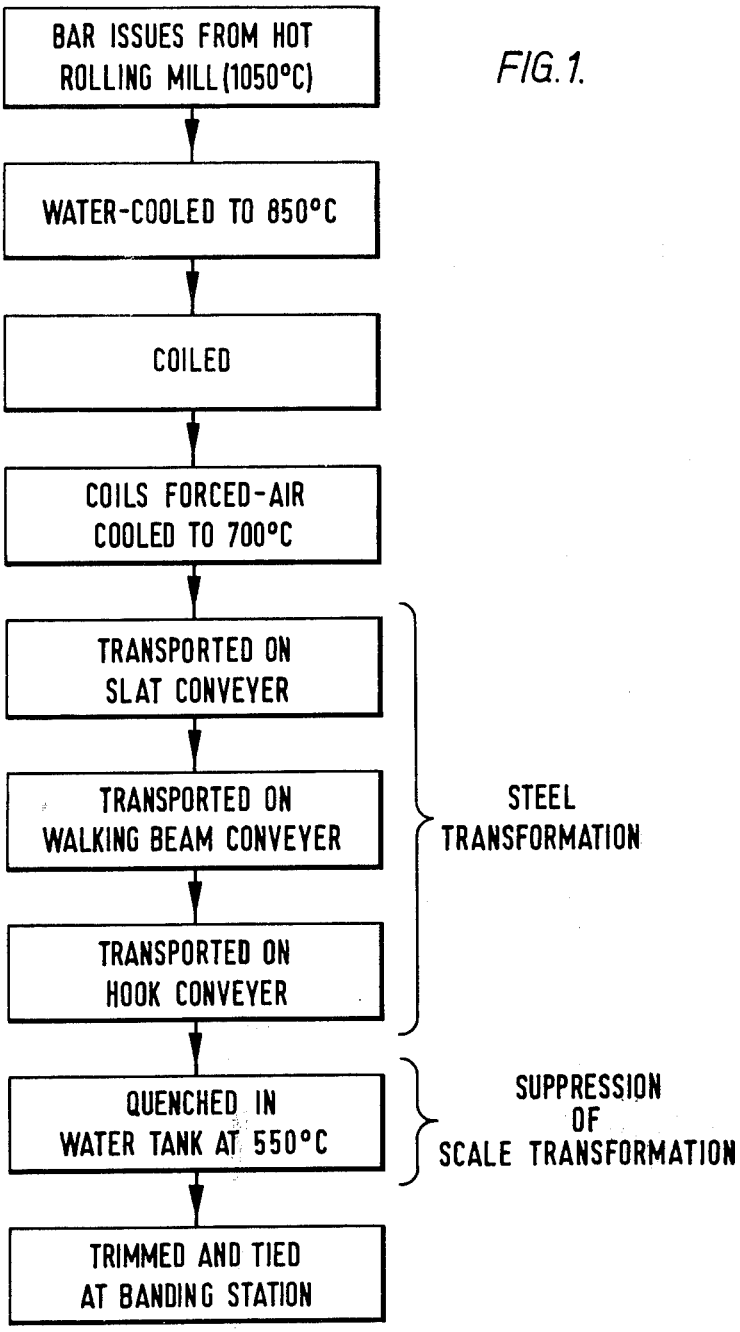
FIG. 1 shows the process route for coiled bar.

Referring now to FIG. 1 there is shown the process route for mild steel bar of, say 38mm diameter although it is to be understood that this process route will be common to all other steel grades to which this invention is applicable, only the individual processing periods and temperatures being different.

More particularly, mild steel bar issues from the hot rolling mill at a temperature of about 1050°C and is immediately passed through water boxes where it is cooled to 850°C in about one second. The cooled bar is then coiled horizontally on a coiler in a bundle weighing about 4000 lbs; succeeding bar lengths being coiled on separate coiler units in bundles of the same weight. The coiled bar is then taken off the coiler and is forced-air cooled from the inside to a surface temperature of about 700°C. This period of cooling may typically be about four minutes depending on the volume and temperature of the air blown.

The coiled bar is then transported along a slat conveyor in free air and is then taken up by a walking-beam conveyor and transported to an overhead endless hook conveyor where it is carried vertically. Hitherto transportation along the conveyor has been in the horizontal 'eye-up' mode to avoid possible sagging of the coil if it had been laid vertically at 700°C.

This free air cooling stage continues for thirty minutes or so until the temperature of the hottest part of the coiled bar, i.e. the inner laps, is about 550°C, the body of the bar now being fully transformed from austenite to ferrite/pearlite. The coil is then submerged in a water bath to quench-in the scale formed on the surface, the temperature of the water bath being maintained at about 70°C.

As mentioned above the scale formed on the surface is mainly wustite with some magnetite at the interface, and transformation to magnetite is suppressed by this quenching step, the thickness of the scale additionally having been kept to a minimum by the process route.

FInally, the coiled bar is conveyed to a 'banding' station where it is trimmed and tried, the coils now being at a suitable temperature for handling.

Figure 2:
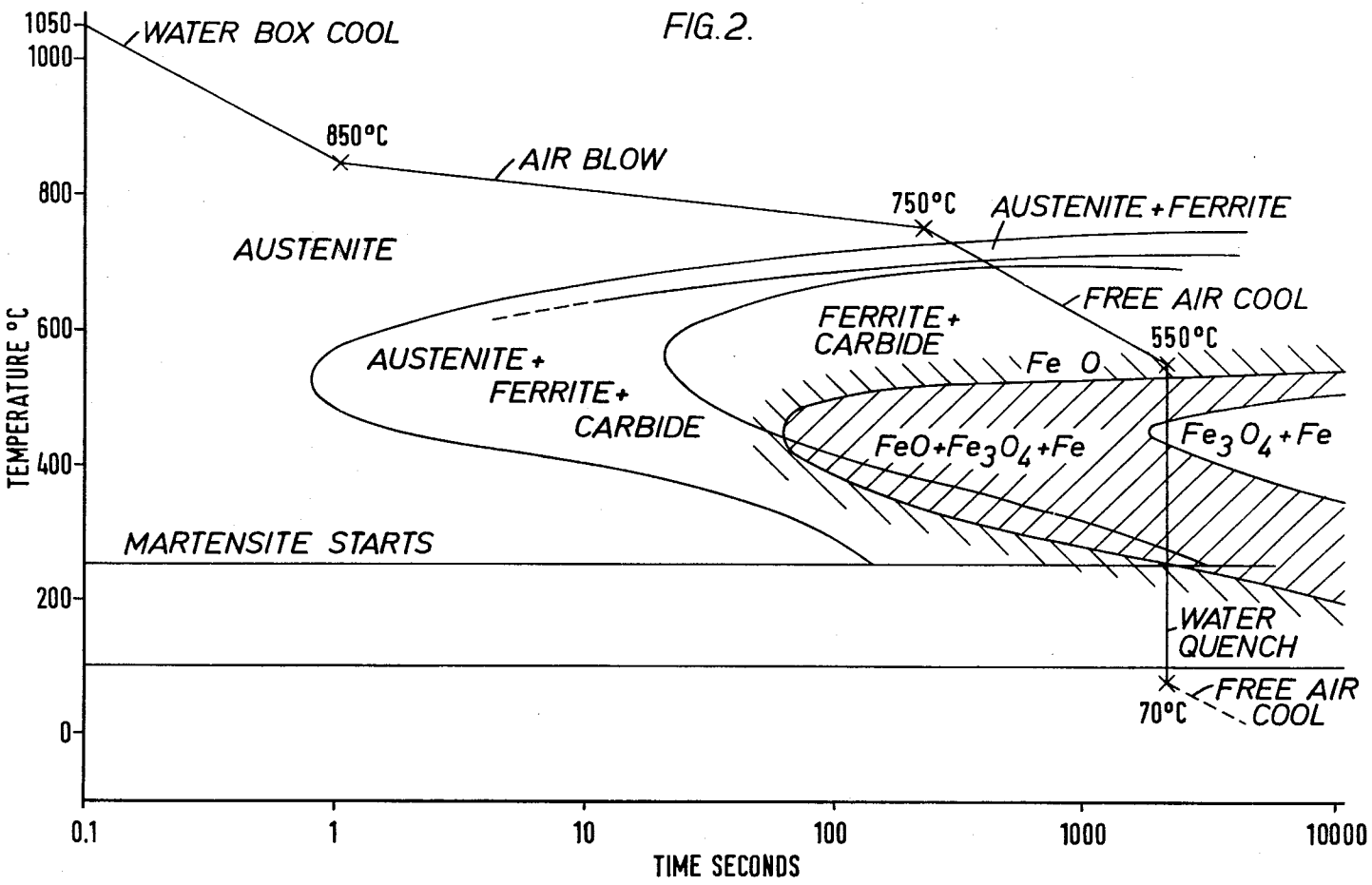
FIG. 2 shows the isothermal transformation of mild steel and wustite.

The phases of transformation throughout this process, both of the steel and the scale, are schematically illustrated in FIG. 2 where the accelerated continuous cooling trace as defined by this invention has been superimposed on the isothermal transformation diagram appropriate to those bodies. This gives a general indication of the conditions obtaining at any time.

Figure 3:
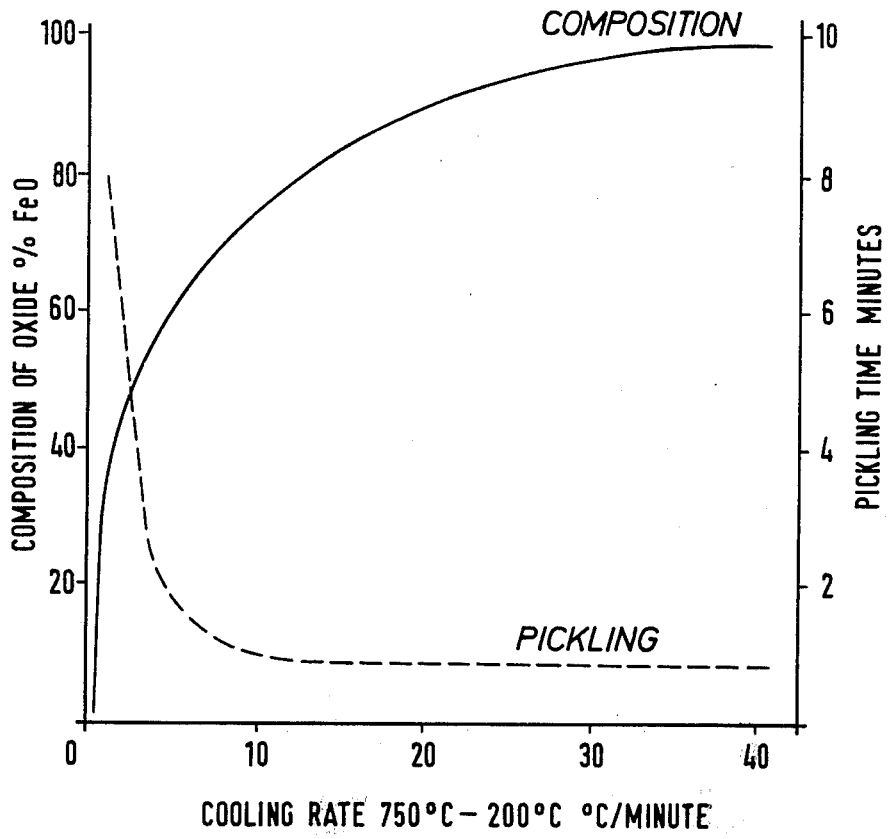
FIG. 3 shows the effect of cooling rate on pickling and composition of scale.

FIG. 3 shows the effect of cooling rate on pickling and the composition of the scale. The faster the cooling rate (below 750°C) the greater the percentage of wustite (FeO) in the scale and conversely the greater is this proportion the faster is the pickling time.

This of course is idealised and in fact a constant cooling rate from the temperature mentioned is not adopted since quench cooling is effected at 550°C in the example given. This quench cooling further diminishes the pickling period diagrammatically illustrated in this figure. The higher this quench temperature the greater the reduction in pickling time, but the greater also is the danger of hardening the stock by reason of carbon being retained in solid solution which might otherwise have precipitated as carbide.

At the higher temperature end, i.e. where water cooling and forced air cooling are effected in succession, a reduction in the amount of scale formed on the inner laps of the coil of over 95 percent is achieved in some instances as compared with free air cooling over this temperature range.

Overall, with the mild steel bar coiled in a 4000 lb. bundle and processed in accordance with the embodiment described, the maximum scale thickness on the coil is reduced by about 80 percent as compared with a free air cooled coil, giving a reduction in pickling time of about 50 percent. Thus, better utilisation of the pickling liquor is obtained and in addition the surface condition is generally improved because the scale is more completely removed.

Although this invention has been described with reference to the particular embodiment illustrated it is to be understood that various modifications may be made without departing from the scope of this invention. For example, the temperatures and times listed may of course be varied in dependence on the bar size and composition and the weight of the coil. The position of the quenching tank, or more particularly the speed of the overhead hook conveyor, may of course be varied to suit the conditions required.

Spray cooling could for example be substituted for the forced air cooling step, the latter simply being preferred because it is more flexible and more readily controllable.

Furthermore, the invention could equally well be applied to straight bar or rod in which case forced air cooling need not be employed because the restriction attendant on the initial water cooling step, i.e. the power required for coiling a hardened bar, would not be relevant.

We claim:

1. A method of cooling hot rolled steel stock in which the stock is rapidly cooled immediately after rolling to a temperature ($t_1$) not less than that at which transformation of the body of the stock from austenite begins, it is then free air cooled to a temperature ($t_2$) not less than that at which scale transformation from wustite begins, and it is then water cooled to quench-in and suppress the transformation of the scale to magnetite.

2. A method according to claim 1, in which the initial rapid cooling comprises water cooling followed by forced air cooling.

3. A method according to claim 2, in which the stock is coiled upon the completion of water cooling at which the stock is at a temperature $t_1'$ at which it is still sufficiently ductile to be readily coiled.

4. A method according to claim 3, in which, for mild steel, low/high carbon steels (up to 1%C) low alloy steels and semi/free-cutting steels the said temperatures are as follows:

$t_1'$ between 830°C and 900°C, $t_1$ between 700°C and 750°C and $t_2$ between 480°C and 550°C.

5. A method according to claim 4, in which the stock is coiled horizontally and is forced air cooled from the inside, and in which the stock is conveyed from the coiler for free air cooling initially in the eye-up mode.

6. A method according to claim 5, in which the rapid water cooling following rolling is effected by water sprays directed on to the stock as it passes through a water box in the form of an elongated tube.

7. A method according to claim 6, in which the final water cooling is effected by submerging the stock in a water tank maintained at a temperature of about 70°C.

8. A method of cooling hot rolled steel stock in which the stock is a. water cooled immediately after rolling to a temperature $t_1'$, b. wound horizontally into a coil, c. forced air cooled until the temperature of the coiled stock attains a value $t_1$, d. free air cooled until the temperature of the coiled stock attains a value $t_2$, e. quench cooled in a water tank the temperature $t_1'$ being such that the steel is still just sufficiently ductile to be readily coiled, the temperature $t_1$ being not less than that at which transformation of the body of the stock from austenite begins and the temperature $_2$ being not less than that at which scale transformation from wustite begins, the quench cooling being effective to suppress the transformation of the scale to magnetite.

9. A method according to claim 8, in which, for mild steel, low/high carbon steels (up to 1%C) low alloy steels and semi/ free-cutting steels the said temperatures are as follows:

$t_1'$ between 830°C and 900°C $t_1$ between 700°C and 750°C, and $_2$ between 480°C and 550°C, the temperature $t_1$ and $t_2$ being measured at, and representative of, the inner laps of the coiled stock.

10. Steel bar or rod which has been subjected to a method of cooling according to claim 9.

* * * * *